US011312530B2

(12) United States Patent
Wang et al.

(10) Patent No.: US 11,312,530 B2
(45) Date of Patent: Apr. 26, 2022

(54) SPEAKER PACKAGING DEVICE AND PACKAGE BODY

(71) Applicant: Suzhou Sonavox Electronics Co., Ltd., Suzhou (CN)

(72) Inventors: Yu Wang, Suzhou (CN); Xiaoping Gu, Zuzhou (CN); Yuezhen Li, Suzhou (CN); Xiaoqing Wang, Suzhou (CN); Guoqiang Chai, Suzhou (CN)

(73) Assignee: Suzhou Sonavox Electronics Co., Ltd., Suzhou (CN)

( * ) Notice: Subject to any disclaimer, the term of this patent is extended or adjusted under 35 U.S.C. 154(b) by 382 days.

(21) Appl. No.: 16/491,913

(22) PCT Filed: Sep. 21, 2018

(86) PCT No.: PCT/CN2018/106898
§ 371 (c)(1),
(2) Date: Sep. 6, 2019

(87) PCT Pub. No.: WO2019/085675
PCT Pub. Date: May 9, 2019

(65) Prior Publication Data

US 2021/0130034 A1 May 6, 2021

(30) Foreign Application Priority Data

Nov. 3, 2017 (CN) ..... 201721450027.6

(51) Int. Cl.
*B65D 5/49* (2006.01)
*B65D 85/68* (2006.01)

(52) U.S. Cl.
CPC ..... *B65D 5/48038* (2013.01); *B65D 85/68* (2013.01); *B65D 2585/684* (2013.01)

(58) Field of Classification Search
CPC ..... B65D 5/48038; B65D 85/68; B65D 2585/684
See application file for complete search history.

(56) References Cited

U.S. PATENT DOCUMENTS 2,633,285 A * 3/1953 Kells ..... B65D 5/48038 229/120.05
2008/0217389 A1* 9/2008 Bos ..... B65D 5/48038 229/120.36

FOREIGN PATENT DOCUMENTS

CN 200820303700.8 12/2009
CN 201520118088.7 9/2015
(Continued)

OTHER PUBLICATIONS

International Search Report and Written Opinion in PCT Application No. PCT/CN2018/106898, dated Dec. 25, 2018 (9 pages).
(Continued)

*Primary Examiner* — Mollie Impink
(74) *Attorney, Agent, or Firm* — Peter L. Brewer; Thrive IP

(57) ABSTRACT

A speaker packaging device. The speaker packaging device comprises a base plate for supporting a plurality of speakers. The speaker packaging device also comprises a series of transverse baffles and a series of pairs of longitudinal baffles. The transverse baffles and the longitudinal baffles interlock over the base plate, forming a matrix of individual cells, or baffle units. Notches are preserved along each longitudinal baffle for accommodating the outer edges of the respective speakers within each baffle unit. In addition, a gap is preserved between adjacent baffle units to further accommodate the outer edges of the respective speakers. The notches are staggered along adjacent baffle units to conserve space.

8 Claims, 3 Drawing Sheets

(56) References Cited

FOREIGN PATENT DOCUMENTS

| | | | | |
|---|---|---|---|---|
| CN | 201520324638.0 | | | 9/2015 |
| CN | 201620100536.5 | | | 7/2016 |
| CN | 106865030 | A | * | 6/2017 |
| CN | 201721450027.6 | | | 6/2018 |
| KR | 20100054365 | A | * | 5/2010 |
| WO | 2019/085675 | A1 | | 5/2019 |

OTHER PUBLICATIONS

Machine Translation of the International Search Report in PCT Application No. PCT/CN2018/106898, dated Dec. 25, 2018 (2 pages).
Machine Translation of the Abstract of CN Patent Application No. CN 200820303700.8 published Dec. 9, 2009 (1 page).
Machine Translation of the Abstract of CN Patent Application No. CN 201520118088.7 published Sep. 16, 2015 (1 page).
Machine Translation of the Abstract of CN Patent Application No. CN 201520324638.0 published Sep. 2, 2015 (1 page).
Machine Translation of the Abstract of CN Patent Application No. CN 201620100536.5 published Jul. 6, 2016 (1 page).
Machine Translation of the Abstract of CN Patent Application No. CN 201721450027.6 published Jun. 29, 2018 (1 page).

* cited by examiner

SPEAKER PACKAGING DEVICE AND PACKAGE BODY

STATEMENT OF RELATED APPLICATIONS

The present application is filed under 35 U.S.C. § 371, and claims priority to PCT/CN2018/106898 filed Sep. 21, 2018. That application is entitled "Speaker Packaging Device and Package Body."

The PCT application, in turn, claims priority from Chinese Patent Application No. CN201721450027.6 filed on Nov. 3, 2017. These applications are referred to and incorporated herein in their entireties by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

TECHNICAL FIELD OF THE INVENTION

The present disclosure relates to the field of packaging for electronics. More particularly, the present disclosure relates to the field of speakers, and in particular to a speaker packaging device and package body.

BACKGROUND OF THE INVENTION

As the paper cone of the speaker is relatively fragile, it is susceptible to damage or malfunction due to bumping or falling in the process of loading, unloading, handling, and long-distance transportation. In order to protect the speaker during transit, a flexible cushioning material is generally used as an inner cushion. However, this kind of design can make the actual operation cumbersome, and thus generate more package waste which is not environmentally friendly. In addition, the ordinary paper block can only separate products in a container, and is not suitable for speakers with irregular shapes.

SUMMARY OF THE INVENTION

In view of the above problems, the present disclosure aims to provide a speaker packaging device and package body which has a simple structure and offers improved protection speakers in transit.

In one embodiment of the invention, the invention provides:

- a speaker packaging device, comprising a base plate for carrying a speaker,
- at least two transverse baffles extending in a left-right direction, and
- at least two longitudinal baffles extending in a front-rear direction and spaced apart, together with the at least two transverse baffles forming a baffle unit.

The bottom portions of the transverse baffles and of the longitudinal baffles are respectively connected to the base plate. Adjacent transverse baffles are spaced apart in the front-rear direction, while longitudinal baffles are arranged in pairs to form a baffle unit. The baffle units are connected with adjacent two transverse baffles to enclose a space for accommodating a speaker.

The longitudinal baffles are provided with notches. The notches are used for clamping a protruding portion of an outer edge of the speaker. The notches on the two longitudinal baffles of each longitudinal baffle unit are aligned.

In some embodiments, the speaker packaging device includes a plurality of columns of the baffle units. Each column of the baffle units has a plurality of pairs of longitudinal baffles arranged in the front-rear direction. At the same time, notches of the longitudinal baffles in one column of baffle units are opened at front portions of the longitudinal baffles, while the notches of the longitudinal baffles in an adjacent column of baffle units are opened at rear portions of the longitudinal baffles. The two adjacent baffle units are separated by a distance.

In a preferred embodiment, the notches of two adjacent baffle units are arranged in the front-rear direction so that the protruding portions of the outer edges of two adjacent speakers are staggered in the front-rear direction and stored in the space between two adjacent baffle units.

In some embodiments, a width of the notch is less than or equal to half a length of the longitudinal baffle.

In some embodiments, the longitudinal baffles in a left side of the plurality of pairs of longitudinal baffles in each column of baffle units are formed in one piece, and the longitudinal baffles in a right side of the plurality of pairs of longitudinal baffles in each column of baffle units are also formed in one piece.

In some embodiments, a bottom of the transverse baffle is opened with a downward slot. The slot is clamped with the longitudinal baffle to connect the transverse baffle and the longitudinal baffle.

In some embodiments, the slot is matched with a portion below the notch of the longitudinal baffle and is clamped with the portion below the notch of the longitudinal baffle.

In some embodiments, the transverse baffle and/or the longitudinal baffle is fabricated from a corrugated cardboard material. In addition, the base plate is a bottom plate of a corrugated carton or a bottom plate of a corrugated box. The transverse baffle and the longitudinal baffle are arranged in the corrugated carton or the corrugated box.

According to another aspect, the invention provides a speaker package body. The speaker package body comprises a speaker and the speaker packaging device as described above. The speaker is placed in the space enclosed by the longitudinal baffles and the transverse baffles. At the same time, the protruding portion of the outer edge of the speaker is clamped in the notch of the longitudinal baffle.

According to a third aspect of the present disclosure, the invention provides a speaker package body. The speaker package body comprises the speaker packaging device and a plurality of speakers. The speakers are placed in the spaces, or units, enclosed by the longitudinal baffles and the transverse baffles of the packaging device. Protruding portions of the outer edges of the speakers are clamped in the notches of the longitudinal baffles.

In the third aspect, a front of a first speaker faces a front transverse baffle and a back of the first speaker faces a rear transverse baffle along one column of a first baffle unit. At the same time, a front of a second speaker faces a rear transverse baffle and a back of the second speaker faces a front transverse baffle along one column of an adjacent second baffle unit. Protruding portions of the outer edges of the adjacent columns of speakers are accommodated between the adjacent columns of the baffle units and are staggered in the front-rear direction.

The present disclosure adopts the above scheme and has the following advantages compared with the prior art:

A notch is opened on each longitudinal baffle of the pair of longitudinal baffles which are placed at the two relative sides of the corresponding speaker. When the speaker is placed in the space enclosed by two adjacent transverse baffles and a pair of longitudinal baffles, the protruding portions on the side of the speaker such as outer edges of a frame are just clamped in two aligned notches to secure the speaker and to militate against external impact. An inflexible cushioning material can be not used, and the packaging device has a simple structure; the outer edges of the adjacent two columns of speakers are accommodated between two adjacent columns of baffle units and staggered in the front-rear direction, which improves the utilization of the packaging space.

BRIEF DESCRIPTION OF THE DRAWINGS

For explaining the technical solutions in the embodiments of the present disclosure more clearly, the accompanying drawings used in describing the embodiments are introduced. It is understood that the following described drawings are merely illustrative, and other drawings can be obtained according to these drawings by one of ordinary skill in the art without creative work, wherein.

In the above drawings.

100—speaker packaging device; 150—paper block; 152—corrugated outer box; 154—bottom end of the paper box; 200—speaker package body; 1—base plate; 2—transverse baffle; 31—first column of baffle units 45; 32—second column of baffle units 45; 3*a*—left longitudinal baffle; 3*b*—right longitudinal baffle; 300—notch; 50—speaker; 55—speaker cone; 40—protruding portion; 5—side plate; 58—speaker frame; 52—back of the speaker; 54—front of the speaker 50; 14—bottom of the transverse baffles 31 or 32; 36—rear portion of the transverse baffles 31 or 32; 38—front portion of the transverse baffles 31.

DETAILED DESCRIPTION OF CERTAIN EMBODIMENTS

In the following Description, certain embodiments of the present disclosure are explained in detail so that the advantages and features of the present invention can be understood by a person of ordinary skill in the art. It is to be noted that the description of the embodiments is intended to aid in the understanding of the invention, but is not intended to limit the invention, which is to be determined by the claims. Further, the technical features in the various embodiments of the present disclosure described below may be combined with each other as long as they do not constitute a conflict with each other.

The orientation words mentioned in the present disclosure are defined by the conventional viewing angle of the packaging device 100. For example, "front", "back", "left", and "right" respectively correspond to the upper side, the lower side, the left side, and the right side of the paper surface in FIG. 2.

Figure 1:
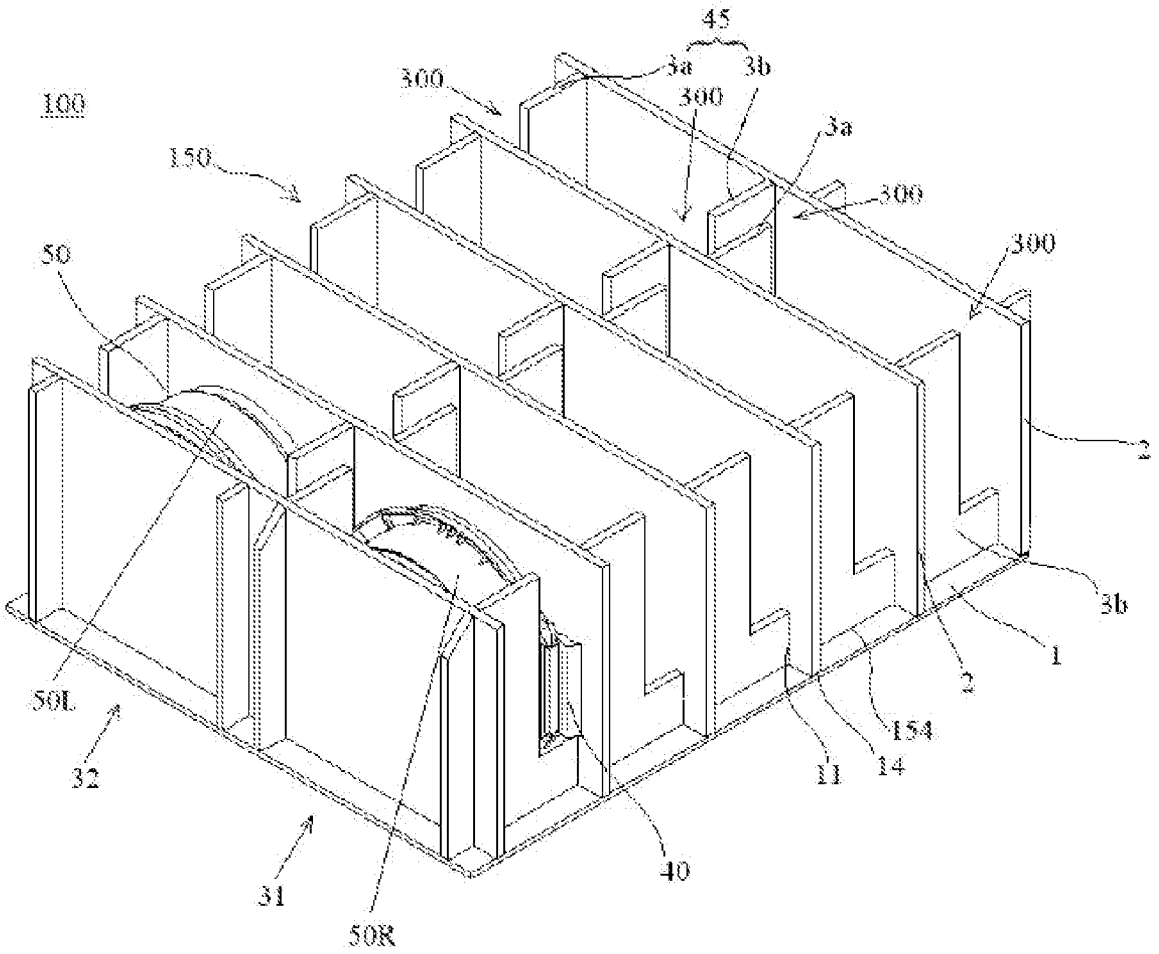
FIG. 1 is a perspective view of the package body and packaging device according to an embodiment.

This embodiment provides a speaker packaging device 100 for containing a speaker 50 and for protecting the speaker 50 during transportation. As shown in FIG. 1, the packaging device 100 for the speaker 50 includes a base plate 1 for carrying a speaker, at least two transverse baffles 2 residing above the base plate 1 and extending in a left-right direction, and at least two longitudinal baffles 3*a*, 3*b* also residing above the base plate 1.

The base plate 1 is preferably a bottom of a corrugated carton or a bottom of a corrugated box. The number of the transverse baffles 2 is plural and they are arranged at equal intervals in a front-rear direction, while the number of the longitudinal baffles 3*a*, 3*b* is also plural and they intersect with the transverse baffles 2 to form a paper block, or matrix 150. The matrix 150 forms a plurality of cells, referred to herein as "units."

Figure 2:
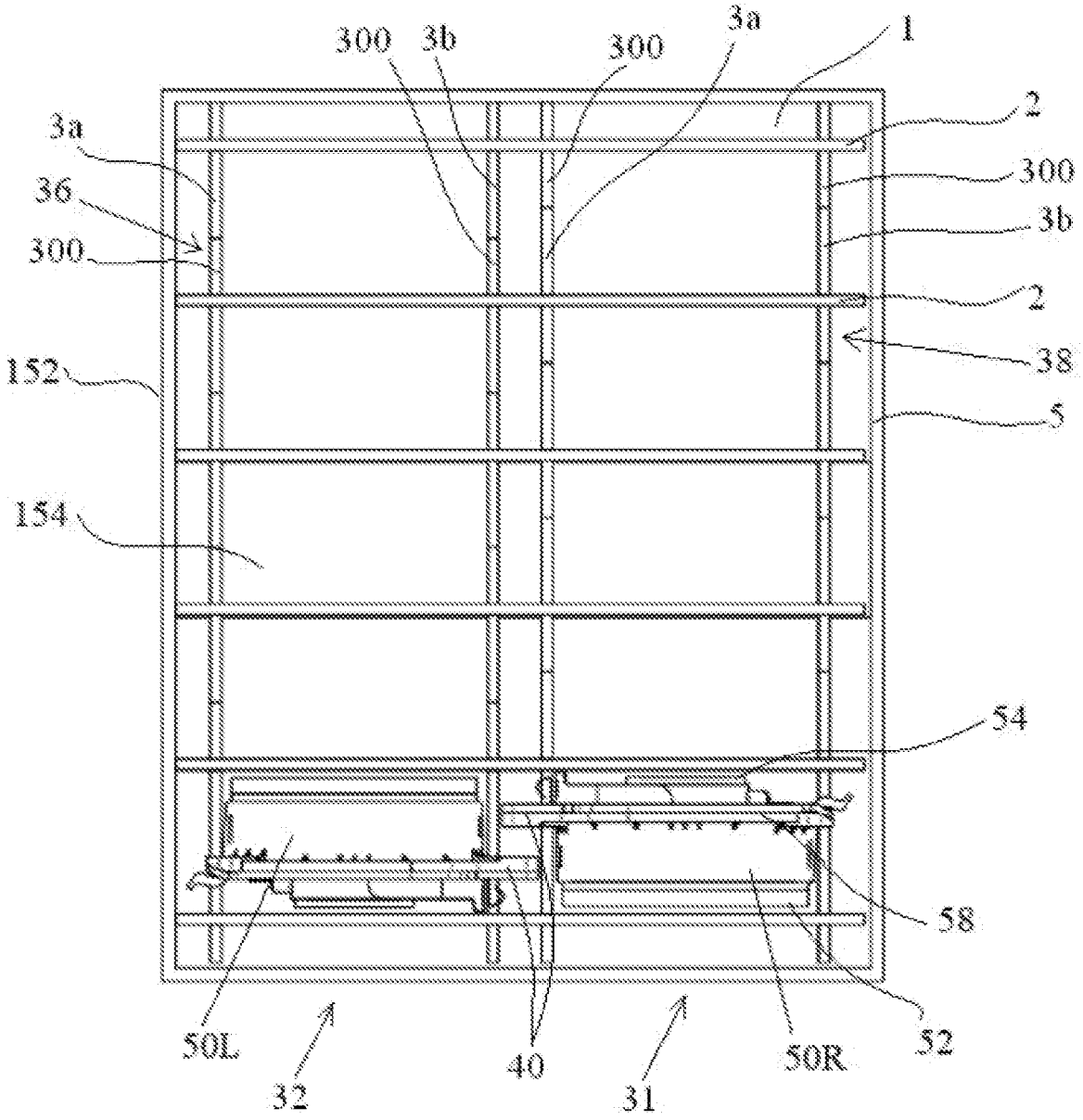
FIG. 2 is a top view of the package body and packaging device according to an embodiment.

As shown in FIG. 2, the paper block 150 is connected to a corrugated outer box 152, and the corrugated outer box 152 includes a base plate 1 connected to a bottom end 154 of the paper block 150 and four side plates 5 located around the paper block 150. The overall length and width of the paper block 150 are equal to or slightly smaller than the size of the outer box 152.

Figure 3:
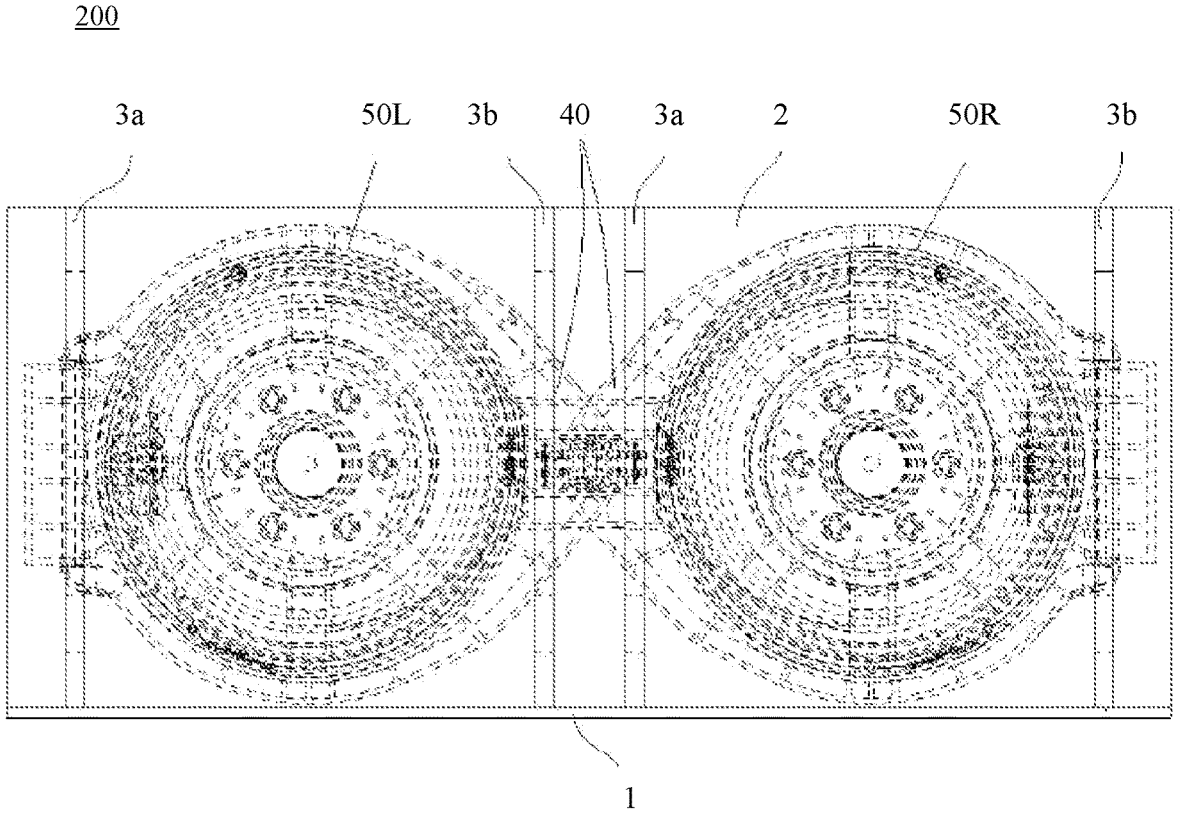
FIG. 3 is a front view of the package body and packaging device according to an embodiment.

Referring to FIGS. 1-3 together, each baffle unit 45 comprises two longitudinal baffles 3*a*, 3*b* extending in the front-rear direction and spaced apart, that is, the longitudinal baffles 3*a*, 3*b* are disposed in pairs. The bottom end portions of the transverse baffles 2 and the longitudinal baffles 3*a*, 3*b* are respectively connected to the base plate 1, and the adjacent transverse baffles 2 are spaced apart in the front-rear direction, and longitudinal baffles 3*a*, 3*b* arranged in pairs in each baffle unit 45 are connected with the adjacent two transverse baffles 2 to enclose a space for accommodating the speaker 50.

As shown in FIG. 2, the number of the units (or spaces) is 10, and 10 speakers 50 can be accommodated. Each unit 45 accommodates a speaker 50.

Each longitudinal baffle 3*a*, 3*b* is opened with a notch 300 for clamping a protruding portion 40 of a speaker 50. More specifically, the notch clamps an outer edge 51 associated with each speaker 50. Notches 300 of the two longitudinal baffles 3*a*, 3*b* of one baffle unit 45 are aligned. The protruding portion 40 of the outer edge of the speaker 50 refers to the outer edge of a speaker frame 58 for securing a speaker cone 55 portion of a speaker 50, clamping the opposite sides of the outer edges of the frame 58 with the notches 300 in the pair of longitudinal baffles 3*a*, 3*b* in purpose of securing and protecting the speaker cone 55.

The speaker packaging device 100 includes a plurality of columns 31, 32 of the baffle units 45, each column 31, 32 of the baffle units 45 has a plurality of pairs of longitudinal baffles 3*a*, 3*b* arranged orderly in the front-rear direction, and notches 300 of longitudinal baffles 3*a*, 3*b* in one column 31 of baffle units 45 are opened at a front portion of the longitudinal baffles 3*a*, 3*b*, notches 300 of longitudinal baffles 3*a*, 3*b* in adjacent column 32 of baffle units 45 are opened at a rear portion 36 of the longitudinal baffles 3*a*, 3*b*, and two adjacent baffle units 45 are spaced apart by a distance.

As shown in FIGS. 1-3, the packaging device 100 specifically comprises a first column 31 of baffle units 45 and a second column 32 of baffle units 45. Each column 31, 32 comprises five baffle units 45, while each baffle unit 45 comprises a left side longitudinal baffle 3*a* and a right longitudinal baffle 3*b*, the left longitudinal baffle 3*a* and the right longitudinal baffle 3*b* each being provided with a notch 300. The difference is that the notch 300 in the first column 31 of the baffle units 45 is opened at a front portion 58 of each longitudinal baffle 3*a*, and the notch 300 in the second column 32 of baffle units 45 is opened at a rear portion 56 of each longitudinal baffle 3*b*.

The width of each notch 300 is less than or equal to half of the length of the associated longitudinal baffle 3*a* or 3*b* such that the notch 300 in the left longitudinal baffle 3*a* of the first column 31 of baffle units 45 and the notch 300 in the right longitudinal baffle 3*b* of the second column 32 of baffle units 45 are arranged in the front-rear direction, so that after the speakers 50 are placed, the protruding portions 40 of the outer edges of the adjacent two speakers 50 are staggered in the front-rear direction and stored in the adjacent two baffle units 45.

It should be noted that all of the left longitudinal baffles 3*a* in the plurality of pairs of longitudinal baffles of each column 31, 32 of the baffle units 45 are formed in one piece, and all the right longitudinal baffles 3*b* are formed in one piece. For example, the corrugated cardboards are cut to open a plurality of notches 300 that are at equal intervals in the front-rear direction, that is, a plurality of longitudinal baffles 3*a*, 3*b* on the same side of the column 31 or 32 of baffle units 45 are formed. Then, another cut corrugated cardboard is horizontally turned 180 degrees, that is, a plurality of longitudinal baffles 3*a*, 3*b* on the same side of the adjacent column 31 or 32 of baffle units 45 are formed. In this way, all the longitudinal baffles 3*a*, 3*b* can be made of the same mold to save the cost of opening mold.

The plurality of transverse baffles 2 and the plurality of longitudinal baffles 3*a*, 3*b* intersect each other to form the paper block 150 of the grid-like structure, and are clamped at the intersections. For example, a bottom 14 of the transverse baffle 2 is provided with a downward slot 11, and the slot 11 is clamped with a longitudinal baffle 3*a* or 3*b* to realize the connections of the transverse baffle 2 and the longitudinal baffles 3*a*, 3*b*. The slot 11 is specifically matched with a portion of a longitudinal baffle 3*a*, 3*b* below the notch 300 and is clamped with a portion of the longitudinal baffle 3*a*, 3*b* below the notch 300; that is, the slot 11 is only opened at the bottom 14 of the transverse baffle 2 to ensure the strength of the transverse baffle 2. In addition, the transverse baffle 2 and the longitudinal baffle 3*a*, 3*b* can approach each other to achieve folding or collapsing for easy storage. When packaging, the longitudinal baffles 3*a*, 3*b* and the transverse baffles 2 of the paper block 150 are unfolded and placed in the outer box 152, so that the speakers 50 can be placed, and the size of the paper block 150 is preferably matched with the size of the outer box 152 (equal or slightly smaller).

The embodiment further provides a speaker package body 200, as shown in FIGS. 2-3, including the above-described packaging device 100 and speakers 50 placed in each space 45 enclosed by the longitudinal baffles 3*a*, 3*b* and the transverse baffles 2. The outer edges of the speaker frames 58 are clamped in the respective notches 300 of the pair of longitudinal baffles 3*a*, 3*b*, and the front of one speaker 50 being placed between the longitudinal baffles 3*a*, 3*b* of the column of baffle unit 45 faces a front transverse baffle 2 and the back 52 of the speaker 50 faces a rear transverse baffle 2, while a front 54 of one speaker 50 being placed between the longitudinal baffles 3*a*, 3*b* of the adjacent column of baffle units 45 faces a rear transverse baffle 2 and a back 52 of the speaker 50 faces a front transverse baffle 2.

As shown in FIGS. 2-3, the speakers 50L on the left side are horizontally flipped by 180 degrees with respect to the speakers 50R on the right side, and the right protruding portion 40 of the left speaker 50L and the left protruding portion 40 of the right speaker 50R are accommodated in the middle two longitudinal baffles 3*a*, 3*b*, and staggered in the front-rear direction to increase space utilization.

It should also be noted that the speaker packaging device 100 and the package body 200 provided in this embodiment do not include any other buffer materials. This is because the cardboard material is cut according to a point of force where the speaker 50 corresponds to the paper block 150, and the cardboard material can play a role in securing the speaker 50 and minimizing the effects of external impact. The design of the paper block 150 itself can have a protective effect when transporting the fragile parts, particularly the cone 55, to prevent the impact of internal and external forces.

The invention discusses the problem of space utilization in a package 100, and uses a staggered arrangement to cut the corrugated cardboard material making up the package 100, and inserts it in a combined manner, and uses the staggered arrangement of the cardboard material to improve the utilization of the same space product. The force point between the product 50 and the paper block 150, which serves as a barrier, is used to secure the speaker 50 and to avoid the cumbersome steps of adding additional protective material to protect the speaker 50 in the packaging device 100 are eliminated. In addition, it reduces costs.

The above embodiments are merely illustration of the technical concepts and features of the present invention, and are preferred embodiments. It is intended that those skilled in the art can understand the invention and practice the invention, but the scope of the invention is not limited thereto.

What is claimed is:

1. A speaker packaging device, comprising:

a base plate for carrying a plurality of speakers;

a series of transverse baffles extending across the base plate in a left-right direction, and residing in parallel relation to one another; and a plurality of pairs of longitudinal baffles arranged to form a pair of adjacent columns transverse to the transverse baffles, with each column having a series of baffle units extending in a front-rear direction, and with each baffle unit being formed by adjacent transverse baffles and a pair of longitudinal baffles;

wherein:

bottom portions of the transverse baffles and the longitudinal baffles are respectively supported by the base plate, adjacent transverse baffles are spaced apart in the front-rear direction, the longitudinal baffles which are arranged in pair in each longitudinal baffle unit are connected with adjacent transverse baffles to enclose a space for accommodating a respective speaker and to form a matrix of baffle units, each of the longitudinal baffles is provided with notches for accommodating a protruding portion of an outer edge of a respective speaker, with the notches on the longitudinal baffles of each baffle unit being aligned in the front-rear direction, the notches of the longitudinal baffles in one column of longitudinal baffle units are opened at front portions of the longitudinal baffles, while the notches of the longitudinal baffles in the adjacent column of the longitudinal baffle units are opened at rear portions of the longitudinal baffles, and the two adjacent baffle units along each column of baffle units are separated by a distance that defines a gap.

2. The speaker packaging device of claim 1, wherein:

the notches of two adjacent baffle units are arranged in the front-rear direction so that the protruding portions of the outer edges of two adjacent speakers are staggered in the front-rear direction and stored in the gap between the two adjacent baffle units.

3. The speaker packaging device of claim 2, wherein a width of each notch is less than or equal to half a length of a corresponding longitudinal baffle.

4. The speaker packaging device of claim 1, wherein:

longitudinal baffles in a left side of the plurality of pairs of longitudinal baffles in each column of baffle units are formed in one piece, and longitudinal baffles in a right side of the plurality of pairs of longitudinal baffles in each column of baffle units are also formed in one piece.

5. The speaker packaging device of claim 1, wherein:

a bottom of each of the transverse baffles is opened with a downward slot, and each downward slot interlocks with a longitudinal baffle to connect the transverse baffles and the longitudinal baffles and to form the matrix of baffle units.

6. The speaker packaging device of claim 5, wherein the notch of each longitudinal baffle is received within a respective downward slot of a transverse baffle.

7. The speaker packaging device of claim 1, wherein:

each of the transverse baffles and each of the longitudinal baffles is fabricated from a corrugated cardboard material, the base plate is a bottom plate of a corrugated carton or a bottom plate of a corrugated box, and the transverse baffles and the longitudinal baffles are arranged on the corrugated carton or the corrugated box to form the matrix of baffle units.

8. A speaker package body, comprising:

a plurality of speaker packaging devices configured to hold respective speakers and arranged in two adjacent columns, with each speaker packaging device comprising:

a base plate for gravitationally supporting a speaker;

at least two transverse baffles extending in a left-right direction; and a baffle unit comprising two longitudinal baffles extending in a front-rear direction and spaced apart, wherein:

bottom portions of the transverse baffles are respectively supported by the base plate, adjacent transverse baffles are spaced apart in the front-rear direction, and longitudinal baffles which are arranged in pairs in the baffle unit are connected with adjacent transverse baffles to form individual cells for accommodating respective speakers, and the longitudinal baffles are provided with notches configured to accommodate a protruding portion of an outer edge of the respective speaker, with the notches on the longitudinal baffles of each longitudinal baffle unit being aligned;

with the speakers being placed in the individual cells, the protruding portions of the outer edges of the speakers are received in the notches of the longitudinal baffles, with a front of one speaker being placed between the longitudinal baffles of one column of baffle unit faces a front transverse baffle and a back of the speaker faces a rear transverse baffle, while a front of one speaker being placed between the longitudinal baffles of the adjacent column of baffle unit faces a rear transverse baffle and a back of the speaker faces a front transverse baffle, the protruding portions of the outer edges of the adjacent two columns of speakers are are thereby staggered in the front-rear direction.

* * * * *